US006652186B2

(12) United States Patent
Bierwith

(10) Patent No.: US 6,652,186 B2
(45) **Date of Patent: *Nov. 25, 2003**

(54) CLEAT ASSEMBLY FOR TRASH COMPACTOR VEHICLE WHEELS

(76) Inventor: Robert S. Bierwith, 1331 Eastshore Hwy., Berkeley, CA (US) 20350

( * ) Notice: Subject to any disclaimer, the term of this patent is extended or adjusted under 35 U.S.C. 154(b) by 144 days.

This patent is subject to a terminal disclaimer.

(21) Appl. No.: 09/969,961

(22) Filed: Oct. 1, 2001

(65) Prior Publication Data

US 2003/0063951 A1 Apr. 3, 2003

(51) Int. Cl.[7] ..... E01C 19/26
(52) U.S. Cl. ..... 404/124; 37/457
(58) Field of Search ..... 404/124, 121; 37/455, 156, 157

(56) References Cited

U.S. PATENT DOCUMENTS

| | | | | | |
|---|---|---|---|---|---|
| 3,312,004 | A | * | 4/1967 | Johnson | 37/457 |
| 3,664,044 | A | * | 5/1972 | Hahn | 37/456 |
| 3,708,895 | A | * | 1/1973 | Griffith et al. | 37/457 |
| 3,831,297 | A | * | 8/1974 | Lanz et al. | 37/455 |
| 4,213,257 | A | * | 7/1980 | Johansson et al. | 37/457 |
| 4,360,981 | A | | 11/1982 | Bierwith | |
| 4,413,432 | A | | 11/1983 | Bierwith | |
| 4,570,365 | A | | 2/1986 | Bierwith | |
| 4,579,494 | A | | 4/1986 | Bierwith | |
| 4,668,122 | A | * | 5/1987 | Riddle | 404/121 |
| 4,748,754 | A | * | 6/1988 | Schwappach | 37/451 |
| H946 | H | * | 8/1991 | Lonn | 404/121 |
| 5,052,134 | A | | 10/1991 | Bierwith | |
| 5,134,793 | A | | 8/1992 | Bierwith | |
| 5,417,518 | A | | 5/1995 | Bierwith | |
| 5,465,512 | A | * | 11/1995 | Livesay et al. | 37/457 |
| 5,526,592 | A | | 6/1996 | Bierwith | |
| 5,680,717 | A | | 10/1997 | Bierwith | |
| 6,032,390 | A | | 3/2000 | Bierwith | |
| 6,085,448 | A | * | 7/2000 | Gale et al. | 37/458 |
| 6,151,812 | A | | 11/2000 | Bierwith | |
| 6,216,368 | B1 | | 4/2001 | Bierwith | |
| 6,393,738 | B1 | | 5/2002 | Bierwith | |
| 6,415,533 | B2 | | 7/2002 | Bierwith | |
| 2002/0133986 | A1 | * | 9/2002 | Bierwith | 37/455 |
| 2003/0024139 | A1 | * | 2/2003 | Bierwith | 37/456 |
| 2003/0037467 | A1 | * | 2/2003 | Bierwith | 37/455 |

* cited by examiner

*Primary Examiner*—Thomas B. Will
*Assistant Examiner*—Kristine Florio
(74) *Attorney, Agent, or Firm*—Townsend and Townsend and Crew LLP

(57) ABSTRACT

A cleat assembly for trash compactor vehicle wheels that does not use pins to attach replaceable cleats to cleat bases on the trash compactor vehicle wheels. The cleat assembly includes a cleat base with a receiving portion that has a cleat base abutment wall. The cleat assembly also includes a re-useable connection system and a replaceable cleat with an interference portion. The connection system includes a biasing portion that is adjacent to the cleat base abutment wall and a locking portion that is adjacent to the biasing portion when the connection system is in use. The locking portion includes a locking section and an interference section that engage the interference portion of the replaceable cleat. The locking section and the interference section are capable of movement relative to one another to thereby couple the replaceable cleat to the cleat base. The biasing portion includes an abutment section with an abutment opening extending therethrough and a resilient biasing section disposed within, and extending from, the abutment opening. When the connection system is in use, the resilient biasing portion is adjacent to the cleat base abutment wall, as well as to the locking section.

9 Claims, 4 Drawing Sheets

CLEAT ASSEMBLY FOR TRASH COMPACTOR VEHICLE WHEELS

BACKGROUND OF THE INVENTION

1. Field of the Invention

The present invention relates, in general, to trash compactor vehicle wheels and, more particularly, to cleat assemblies for trash compactor vehicle wheels.

2. Description of the Related Art

Trash compactor vehicles are employed in landfill operations to move material (e.g., earth, solid waste, trash and debris) and thereby contour and compact a landfill site. The wheels of such trash compactor vehicles are typically equipped with cleats designed to grind and crush the material and to provide traction for the trash compactor vehicle as it moves the material. Since the cleats become worn with use, it is conventional for a trash compactor vehicle wheel to be equipped with a cleat assembly that includes a replaceable cleat (also referred to as a wear cap) attached to a cleat base. As a result, only the replaceable cleat normally needs (and allows) replacement, thus prolonging the usable life of the trash compactor vehicle wheel and cleat base. U.S. Pat. No. 4,919,566, which is hereby fully incorporated by reference provides a further description of conventional cleat assemblies for trash compactor vehicle wheels.

Generally, the replaceable cleat is attached to the cleat base with a pin. In order to replace a worn cleat with a new one, the worn cleat is released from its attachment to the cleat base by driving the pin out of position with a hammer. During this process, the pin can be destroyed, requiring another pin for attachment of the new cleat to the cleat base. The requirement of additional pins increases expense. Use of a hammer to drive the pin out of position is also undesirable, since it imposes a danger of bodily injury caused by flying chips from the pin or other parts, or from flying dirt, debris, sand, dust, etc.

Further, in conventional cleat assemblies for trash compactor vehicle wheels, the interface between the replaceable cleat and its cleat base can be inadequately sealed. Thus, dirt, sand, grit and other abrasive material can enter the interface and slowly grind or wear the replaceable cleat and cleat base, leading to premature failure.

Still needed in the field, therefore, is a cleat assembly for a trash compactor vehicle wheel that employs a re-useable element to attach a replaceable cleat to a cleat base and that also prevents the intrusion of abrasive material into the interface between the replaceable cleat and cleat base. In addition, the cleat assembly should not require the use of a hammer during exchange of a worn replaceable cleat.

BRIEF SUMMARY OF THE INVENTION

The present invention provides a cleat assembly for a trash compactor vehicle wheel that employs a re-usable connection system to attach a replaceable cleat to a cleat base. Such a re-usable connection system prevents the intrusion of abrasive material into the interface between the replaceable cleat and the cleat base. The cleat assembly for a trash compactor vehicle wheel according to the present invention does not require the use of a hammer during exchange of a worn replaceable cleat.

A cleat assembly for a trash compactor vehicle wheel according to one exemplary embodiment of the present invention includes a cleat base, a replaceable cleat and a connection system for attaching the replaceable cleat to the cleat base. The cleat base has a receiving portion that is at least partially defined by a cleat base abutment wall. The replaceable cleat includes a cleat interference portion.

The connection system includes a biasing portion and a locking portion. The biasing portion includes an abutment section with an abutment opening extending therethrough and a resilient biasing section. The resilient biasing section is disposed in, and extends from, the abutment opening. The resilient biasing section is disposed adjacent to the cleat base abutment wall when the connection system is in use. The locking portion includes a locking section and an interference section, which is configured to engage the cleat interference portion when the connection system is in use. The locking section and interference section are capable of movement relative to one another, and the locking section is disposed adjacent to the resilient biasing section when the connection system is in use.

In a cleat assembly for a trash compactor vehicle wheel according to another exemplary embodiment of the present invention, the locking section and the interference section are separate pieces that are adjacent to one another. In a cleat assembly for a trash compactor vehicle wheel according to yet another exemplary embodiment of the present invention, the locking section and the interference section each include an angled surface that are adjacent to one another. In a cleat assembly for a trash compactor vehicle wheel according to yet another exemplary embodiment of the present invention, the cleat interference portion includes a notch within the replaceable cleat, while the interference section includes a projection.

Accordingly, the present invention provides a cleat assembly that is ideally suited for use on a trash compactor vehicle wheel. The connection system of the cleat assembly is easy to fabricate and, since it preferably extends within the width of the receiving portion of the cleat base, no abrasive material can enter the interface between the replaceable cleat and the cleat base over which it extends. The locking portion of the connection system fully engages the replaceable cleat and the cleat base, with the interference section fully engaging the cleat interference portion of the replaceable cleat, thus providing a tight wedge lock fit and helping prevent relative motion between the replaceable cleat and its associated cleat base.

A connection system of a cleat assembly in accordance with the present invention is reusable, thereby eliminating pin replacement. Such an elimination helps reduce the expense for each cleat exchange. Furthermore, a connection system of a cleat assembly in accordance with the present invention is easily removable without use of a hammer, thereby reducing the possibility of any injuries when exchanging (i.e., replacing) cleats.

A better understanding of the features and advantages of the present invention will be obtained by reference to the following detailed description that sets forth illustrative embodiments, in which the principles of the invention are utilized, and the accompanying drawings.

DESCRIPTION OF SPECIFIC EXEMPLARY EMBODIMENTS OF THE INVENTION

Figure 1:
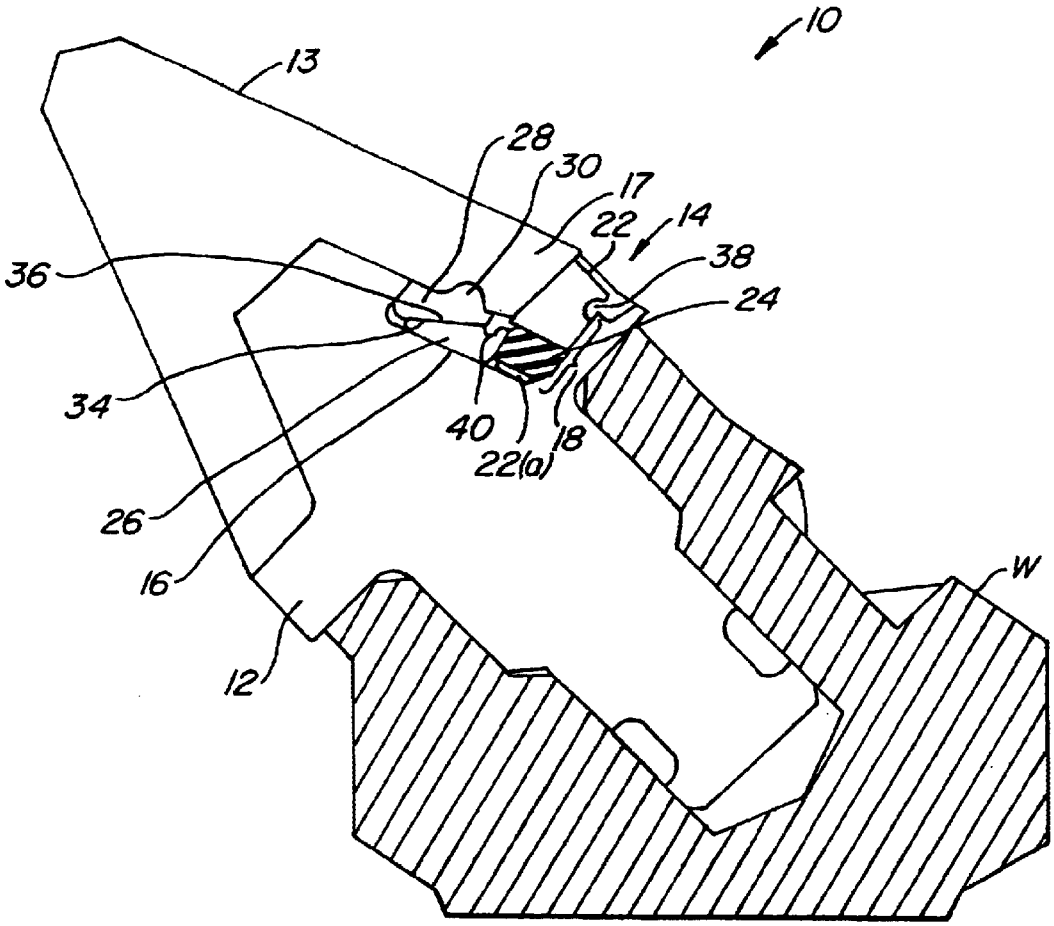
FIG. 1 is a cross-sectional view of a cleat assembly according to one exemplary embodiment of the present invention.
Figure 2:
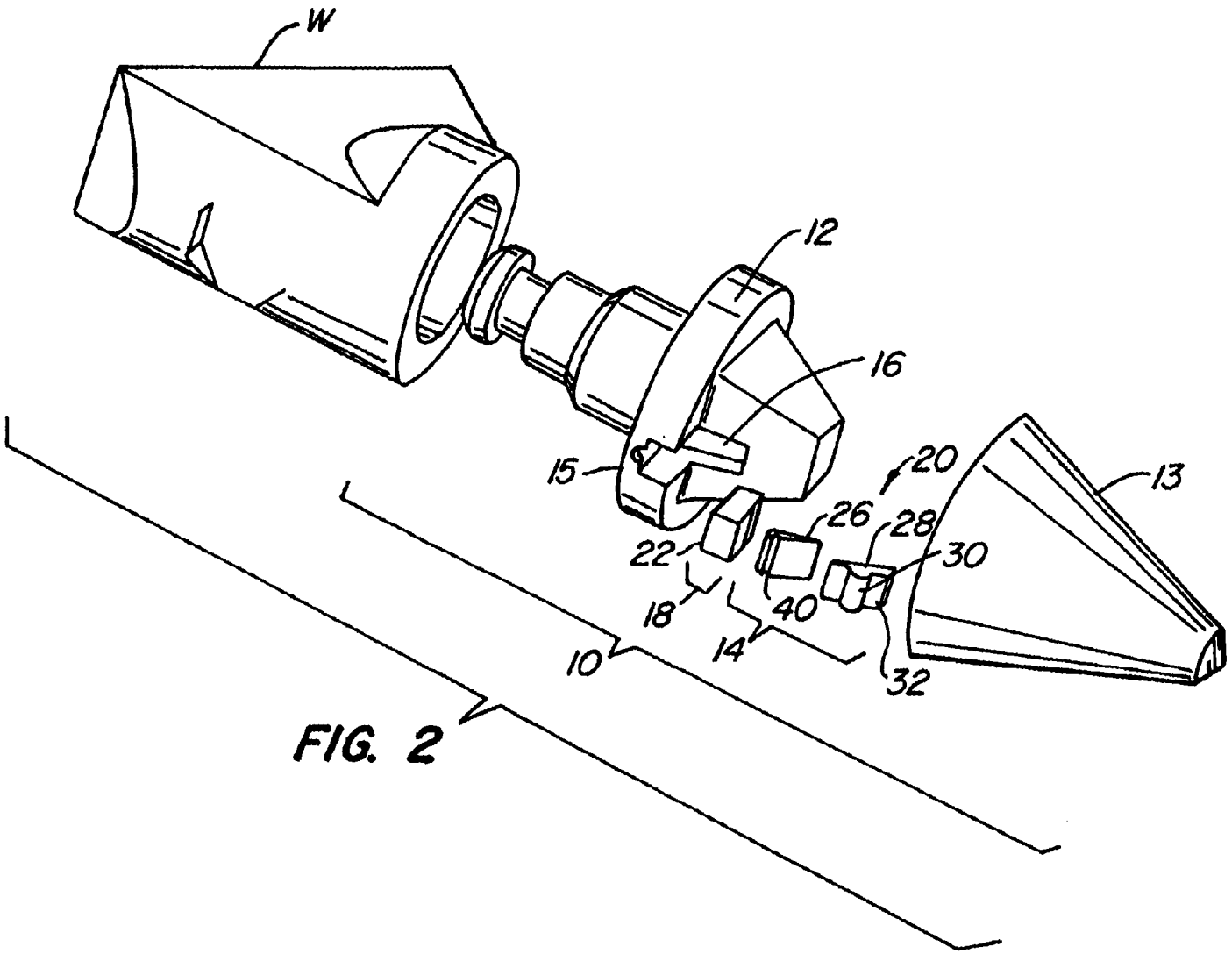
FIG. 2 is an exploded perspective view of the cleat assembly of FIG. 1.
Figure 3:
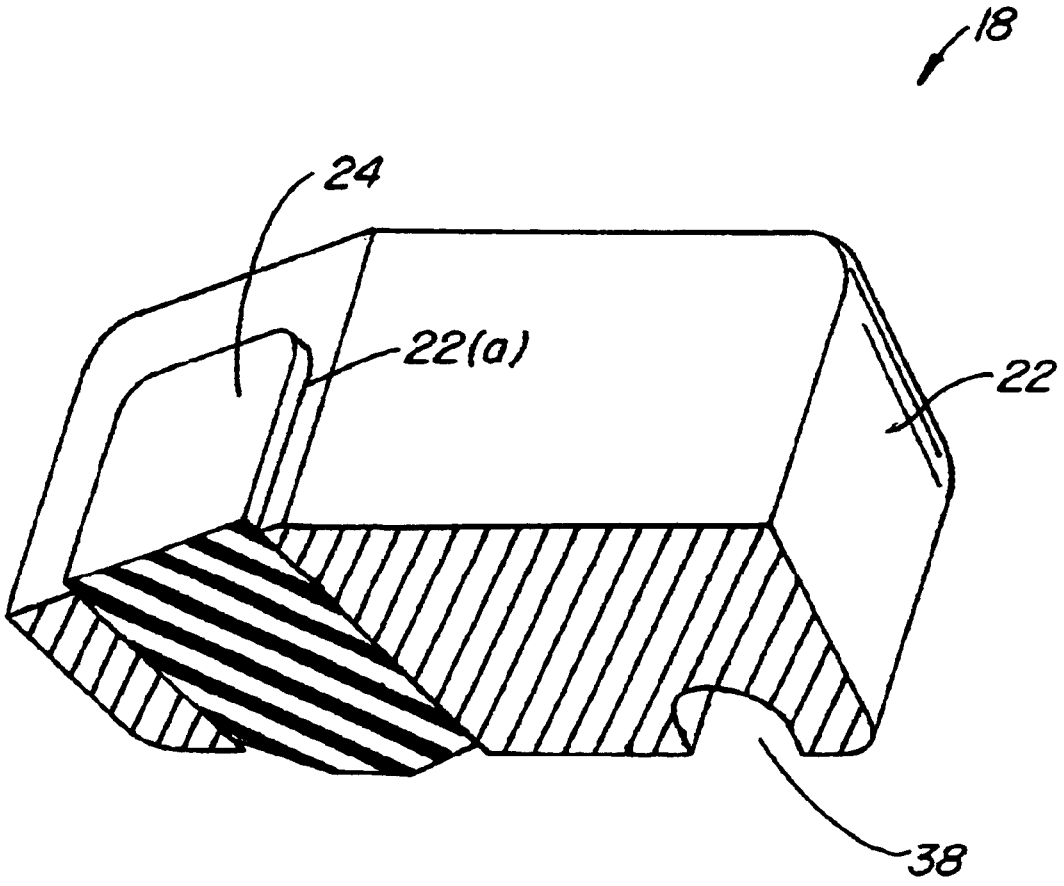
FIG. 3 is a combined perspective and cross-sectional view of the biasing portion of the cleat assembly of FIG. 1.

As illustrated in FIGS. 1–3, a cleat assembly 10 for a trash compactor vehicle wheel (a portion of which is labeled W) includes a cleat base 12, a replaceable cleat 13 and a connection system 14. Cleat base 12 includes a receiving portion 15 defined at least partially by a cleat base abutment wall 16. Replaceable cleat 13 includes a cleat interference portion 17.

Connection system 14 includes a biasing portion 18 and a locking portion 20. Preferably, biasing portion 18 includes an abutment section 22, with an abutment opening 22(*a*) extending completely therethrough, and a resilient biasing section 24. Resilient biasing section 24 is disposed in the abutment opening 22(*a*) and extends therefrom (as shown in FIGS. 1 and 3). Resilient biasing section 24 can include, for example, an elastomeric material (e.g., plastic or rubber), a resilient configuration (e.g., a spring) or a combination of elastomeric and non-elastomeric materials.

Locking portion 20 includes a locking section 26 and an interference section 28. In a cleat assembly for a trash compactor vehicle wheel according to one exemplary embodiment of the present invention, the abutment section, locking section and interference section all include a non-elastomeric material, such as metal. In a cleat assembly for a trash compactor vehicle wheel according to another exemplary embodiment of the present invention, interference section 28 includes a projection 30 defined on its upper surface 32.

As will become apparent herein, interference section 28 and locking section 26 are capable of movement relative to one another. Such a movement may be accomplished, for example, by suitable connection means (e.g., an elastomeric material, rollers, etc.). In the exemplary embodiments illustrated in FIGS. 1–3, locking section 26 and interference section 28 are two separate pieces, both of which have angled surfaces 34 and 36, respectively.

When connection system 14 is in use, angled surfaces 34 and 36 engage one another, as can be seen in FIG. 1. Hence, locking section 26 and interference section 28 have substantially wedge shapes. To provide an optimally tight connection between the replaceable cleat 13 and the cleat base 12, angles surfaces 34, 36 can, for example, engage one another at an engagement angle in the range of 16 degrees to 20 degrees (measured with respect to the portion of the cleat base abutment wall 16, on which locking section 26 is disposed). An engagement angle can be in the range of 16 degrees to 18 degrees.

Connection system 14 is used for attaching replaceable cleat 13 to cleat base 12 (which is in turn connected to trash compactor vehicle wheel W) that are appropriately configured to receive connection system 14. As shown in FIGS. 1 and 2, connection system 14 is mounted within receiving portion 15, which is defined within cleat base 12. To install connection system 14, and thereby connecting replaceable cleat 13 to cleat base 12, locking section 26 is placed within receiving portion 15, while interference section 28 of locking portion 20 is placed underneath it (such that angled surfaces 34 and 36 are engaged). Replaceable cleat 13 is placed over interference section 28 such that projection 30 engages cleat interference portion 17 defined within replaceable cleat 13. Cleat interference portion 17, as can be seen in FIG. 1, includes a notch that cooperates with projection 30 to form an interference fit.

Biasing portion 18 is then placed within receiving portion 15 such that resilient biasing section 24 engages (i.e., is adjacent to) a portion of cleat base abutment wall 16 and locking section 26, as illustrated in FIG. 1, thus forcing locking section 26 under interference section 28. Locking section 26 is capable of sliding under interference section 28 as biasing portion 18 is put in place. This sliding action helps pull replaceable cleat 13 tightly onto cleat base 12 in a self-tightening manner.

Receiving portion 15 and connection system 14 have substantially the same width. Additionally, the interior of replaceable cleat 13 and corresponding surfaces of cleat base 12 are form-fitted. Thus, when connection system 14 is assembled and connecting a replaceable cleat to a cleat base, a seal is provided between them. Accordingly, connection system 14 helps prevent sand, dirt, dust and other abrasive material from entering and "grinding" away at replaceable cleat 13 and cleat base 12, thereby prolonging their life.

To remove connection system 14 and exchange replaceable cleat 13, a prybar (not shown) or other suitable tool is used to dislodge biasing portion 18 from receiving portion 15 by engaging biasing portion slot 38, thereby eliminating the force applied to locking section 26 by resilient biasing portion 24. Locking section 26 can then be disengaged from interference section 28 by, for example, engaging locking section slot 40 formed in locking section 26 with a prybar. Interference section 28 can then be disengaged from cleat interference portion 17. A new replaceable cleat can then be placed onto the cleat base.

In a cleat assembly for a trash compactor vehicle wheel according to one exemplary embodiment of the present invention, resilient biasing portion 24 is made of an elastomeric material, such as rubber. This allows connection system 14 to tightly and snugly fit within receiving portion 15.

Figure 4:
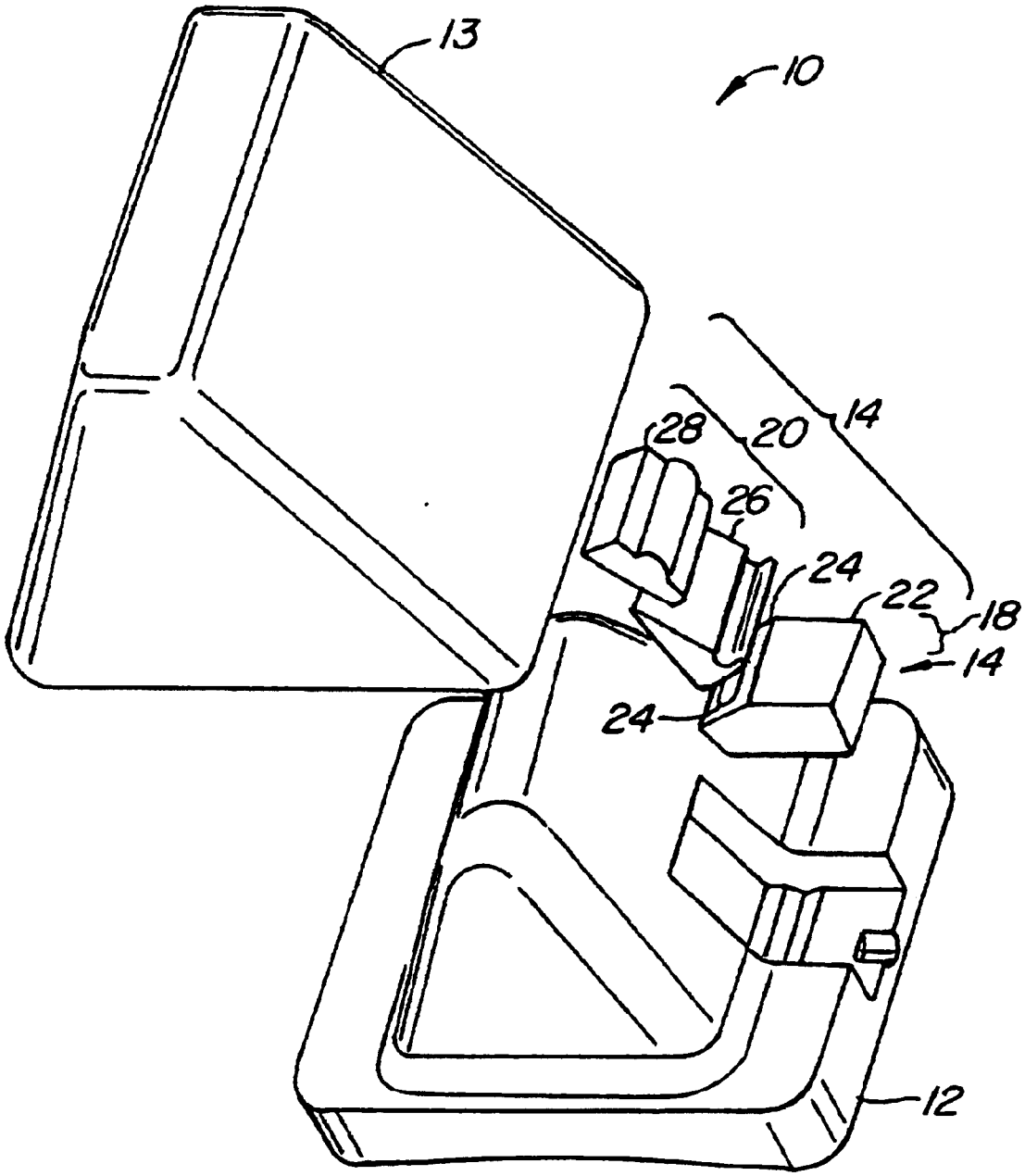
FIG. 4 is an exploded perspective view of a cleat assembly according to another exemplary embodiment of the present invention.

FIG. 4 depicts a cleat assembly 10 for a trash compactor vehicle wheel according to another exemplary embodiment, wherein a cleat base 12 and a replaceable cleat 13 are of a different shape from those shown in the embodiment of FIGS. 1–3. However, cleat assembly 10 of FIG. 4 also includes a connection system 14 and otherwise functions in an essentially identical manner to the cleat assembly 10 of exemplary embodiment shown in FIGS. 1–3. Cleat base 12 of FIG. 4 includes a receiving portion 15 defined at least partially by a cleat base abutment wall 16. Connection system 14 includes a biasing portion 18 and a locking portion 20. Biasing portion 18 includes an abutment section 22, with an abutment opening extending completely therethrough, as well as a resilient biasing section 24 disposed in the abutment opening and extends therefrom. Resilient biasing section 24 can include an elastomeric material (e.g., plastic or rubber), a resilient configuration (e.g., a spring) or a combination of elastomeric and non-elastomeric materials.

Accordingly, the present invention provides a cleat assembly for trash compactor vehicle wheels that includes a connection system that securely couples a replaceable cleat and a cleat base that are configured to receive such a connection system. The connection system eliminates the need for a pin to attach the replaceable cleat to the cleat base. Since the connection system is self-tightening and has improved tolerances, less work is required to fabricate the replaceable cleat and cleat base. The connection system prevents dirt from entering the interface between the replaceable cleat and the cleat base, thereby reducing wear of the cleat base and lowering the frequency the need for replacing the cleat base.

Furthermore, the tightness of fit along the sides and bottom of the replaceable cleat over the cleat base prevents relative motion, thereby further reducing wear and extending the life of the cleat base. The replaceable cleat is virtually immovable on the cleat base, thus minimizing wear on the interior of the replaceable cleat as well as the cleat base. Furthermore, the tightness of fit is achieved without tight manufacturing tolerances since play between the cleat base and the replaceable cleat is taken up by biasing the locking section further under the interference section.

Because the connection system includes a resilient biasing section (e.g., made of rubber), it biases the locking section under the interference section to thereby create a tight "wedged" lock between the two angled surfaces. If the replaceable cleat encounters large debris, and thus is subjected to heavy forces, the replaceable cleat may simply move back toward the cleat base and the connection would become tighter by compressing the resilient biasing portion. Since a hammer is not required to remove the connection system, the risk of injury is minimized. The connection system is also reusable and thus eliminates the cost of replacing pins with each exchanging of a replaceable cleat.

Although the invention has been described with reference to specific exemplary embodiments, it will be appreciated that it is intended to cover all modifications and equivalents within the scope of the appended claims. For example, the receiving portion surface on which the connection system rests may be angled to provide the wedging effect. Also, other arrangements may be used to provide the interference fit between the replaceable cleat and the connection system.

What is claimed is:

1. A cleat assembly for trash compactor vehicle wheels, the cleat assembly comprising:

a cleat base, for attachment to a trash compactor vehicle wheel, with a receiving portion defined at least partially by a cleat base abutment wall;

a replaceable cleat with a cleat interference portion; and a connection system, the connection system including:

a biasing portion, the biasing portion having:

an abutment section with an abutment opening therethrough; and a resilient biasing section disposed in the abutment opening and extending therefrom, the resilient biasing section disposed adjacent the cleat base abutment wall when the connection system is in use; and a locking portion, the locking portion having:

a locking section; and an interference section, wherein the interference section is configured to engage the cleat interference portion when the connection system is in use, and wherein the locking section and interference section are capable of movement relative to one another, and the locking section is disposed adjacent the resilient biasing section when the connection system is in use.

2. The cleat assembly of claim 1, wherein the locking section and the interference section are separate pieces that are adjacent to one another when the connection system is in use.

3. The cleat assembly of claim 2, wherein the interference section and the locking section each include an angled surface, the respective angled surfaces being placed adjacent to one another when the connection system is in use.

4. The cleat assembly of claim 3, wherein the locking section is disposed on a portion of the cleat base abutment wall when the connecting system is in use and wherein the angled surfaces engage one another at an engagement angle in the range of 16 degrees to 20 degrees with respect to the portion of the cleat base abutment wall on which the locking section disposed.

5. The cleat assembly of claim 3, wherein the angled surfaces engage one another at an engagement angle in the range of 16 degrees to 18 degrees with respect to the portion of the cleat base abutment wall on which the locking section is disposed.

6. The cleat assembly of claim 1, wherein the resilient biasing section is made of rubber.

7. The cleat assembly of claim 1, wherein the interference portion includes a notch defined within the replaceable cleat and the interference section includes a projection.

8. The cleat assembly of claim 1, wherein the biasing portion includes a biasing portion slot, the biasing portion slot configured to facilitate dislodging the biasing portion from the receiving portion.

9. The cleat assembly of claim 1, wherein the locking section includes a locking section slot, the locking section slot configured to facilitate dislodging the locking section from underneath the interference section.

* * * * *